US012000227B1

(12) United States Patent
Bukhamseen et al.

(10) Patent No.: US 12,000,227 B1
(45) Date of Patent: Jun. 4, 2024

(54) UNTETHERED NEAR-WELLBORE STIMULATION

(71) Applicant: Saudi Arabian Oil Company, Dhahran (SA)

(72) Inventors: Ahmed Y. Bukhamseen, Dammam (SA); Saad AlMutairi, Dammam (SA); Fahd Ibrahim AlGhunaimi, Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/092,831

(22) Filed: Jan. 3, 2023

(51) Int. Cl.
*E21B 37/00* (2006.01)
*E21B 31/00* (2006.01)
*E21B 43/26* (2006.01)

(52) U.S. Cl.
CPC ..... *E21B 31/005* (2013.01); *E21B 43/26* (2013.01)

(58) Field of Classification Search
CPC ..... E21B 37/00; E21B 37/06; E21B 31/06; E21B 43/26; E21B 23/00; E21B 21/00
See application file for complete search history.

(56) References Cited

U.S. PATENT DOCUMENTS 4,966,326 A * 10/1990 Slez ..... B08B 9/0495 137/906
5,836,393 A * 11/1998 Johnson ..... E21B 37/08 166/308.1
6,250,388 B1 * 6/2001 Carmi ..... E21B 43/25 166/63
6,702,022 B2 * 3/2004 Kattsyn ..... C09K 8/524 166/371
7,451,823 B2 * 11/2008 Wilson ..... E21B 27/02 166/372
9,617,829 B2 * 4/2017 Dale ..... E21B 43/14
9,683,419 B2 * 6/2017 Coon ..... E21B 47/09
(Continued)

FOREIGN PATENT DOCUMENTS

WO 2016176643 A1 11/2016
WO 2020220087 A1 11/2020

OTHER PUBLICATIONS

International Search Report and Written Opinion issued in corresponding International Application No. PCT/US2024/010053, dated Mar. 25, 2024 (11 pages).

*Primary Examiner* — Kenneth L Thompson
(74) *Attorney, Agent, or Firm* — Osha Bergman Watanabe & Burton LLP

(57) ABSTRACT

A stimulation tool for dislodging material from a perforation formed through a tubular disposed in a wellbore includes a main body formed at least in part from a material that is buoyant in a wellbore fluid, a ballast, a magnet, and a pressure pulse generator. The tool is configured to descend downhole by force of gravity when the ballast is attached and couple, by the magnet, to an interior surface of the tubular upon arrival at a downhole location proximate the perforation. When the tool is coupled by the magnet to the interior of the tubular, the tool transmits pressure pulses from the pressure pulse generator into the perforation, thereby dislodging material from the perforation. The tool de-couples from the interior surface and releases the ballast, thereby permitting the tool to ascend uphole, driven at least partially by a buoyant force exerted by the wellbore fluids.

22 Claims, 15 Drawing Sheets

(56) References Cited

U.S. PATENT DOCUMENTS

| | | | | |
|---|---|---|---|---|
| 11,105,165 | B2 * | 8/2021 | He | E21B 47/12 |
| 11,268,335 | B2 * | 3/2022 | Vick, Jr. | E21B 23/00 |
| 11,268,358 | B2 * | 3/2022 | Jabari | E21B 43/1195 |
| 2018/0163497 | A1 * | 6/2018 | Younger | E21B 29/06 |
| 2020/0131899 | A1 | 4/2020 | Chen et al. | |
| 2022/0010648 | A1 | 1/2022 | Musso et al. | |

* cited by examiner

UNTETHERED NEAR-WELLBORE STIMULATION

TECHNICAL FIELD

The present disclosure is directed to a method and device for near-wellbore stimulation. More particularly, embodiments of the present invention relate to an untethered stimulation tool.

BACKGROUND

During oil and gas production, flow of produced fluids from the producing formation into a wellbore can be hampered by the buildup of mudcake and other particulate and non-particulate matter in the casing perforations or in other near-wellbore areas. So-called stimulation operations can remove some or all of such undesired material, thus bringing production of oil and gas back to desired levels.

Generally, downhole stimulation operations are conducted either by injecting chemicals into a wellbore or by using tethered stimulation tools, which are suspended on a cable, and lowered into the wellbore using, for example, a winch mounted in a logging truck and a crane. In some cases, the conventional tethered stimulation tools are pushed into the wellbore using, for example, coiled tubing, or pushed or pulled along the wellbore using a tractor, or other similar driving mechanism. Conventional tethered stimulations tools and the cable or wiring attached thereto are generally bulky, requiring specialized vehicles and equipment, and a specialized crew of technicians to deploy and operate. The use of these tools can increase the time, expense, and complexity associated with stimulation.

SUMMARY

Certain aspects of the subject matter herein can be implemented as an untethered stimulation tool for dislodging material from a perforation formed through a tubular disposed in a wellbore. The tool includes a main body formed at least in part from a material that is buoyant in a wellbore fluid, a ballast, a magnet, and a pressure pulse generator. The tool is configured to, by a force of gravity when the ballast is attached, descend from a wellhead downhole within the tubular, and couple, by the magnet, to an interior surface of the tubular upon arrival of the untethered stimulation tool at a downhole location proximate the perforation. When the untethered stimulation tool is coupled by the magnet to the interior of the tubular, the tool transmits pressure pulses from the pressure pulse generator into the perforation, thereby dislodging material from the perforation. The tool de-couples from the interior surface and release the ballast, thereby permitting the untethered stimulation tool to ascend uphole, driven at least partially by a buoyant force exerted by the wellbore fluids.

An aspect combinable with any of the other aspects can include the following features. The tool can also include a power boost circuit to charge a capacitor to switch a state of the magnet.

An aspect combinable with any of the other aspects can include the following features. The power boost circuit can power the pressure pulse generator.

An aspect combinable with any of the other aspects can include the following features. The de-coupling the untethered stimulation tool can be by switching the magnet.

An aspect combinable with any of the other aspects can include the following features. The releasing of the ballast can be by switching the magnet.

An aspect combinable with any of the other aspects can include the following features. The magnet can be a first magnet and wherein the untethered stimulation tool can further include a second magnet, and wherein the releasing the ballast is by switching the second magnet An aspect combinable with any of the other aspects can include the following features. The untethered stimulation tool can further include a controller. The controller can include a processor and a storage medium. The storage medium can include instructions to direct the processor to measure data correlating to a depth in the wellbore, release the ballast at a target depth, switch a state of the magnet, and activate the pressure pulse generator.

An aspect combinable with any of the other aspects can include the following features. The untethered stimulation tool can include a pressure sensor to collect data correlating to depth.

An aspect combinable with any of the other aspects can include the following features. The untethered stimulation tool can include a casing collar locator to collect data correlating to depth.

An aspect combinable with any of the other aspects can include the following features. The untethered stimulation tool can include a pressure sensor to collect data correlating to depth.

An aspect combinable with any of the other aspects can include the following features. The tubular can include a metallic wellbore casing.

An aspect combinable with any of the other aspects can include the following features. The pressure pulse generator can include a piezoelectric actuator.

Certain aspects of the subject matter herein can be implemented as a method for stimulating a near-wellbore area. The method includes dropping an untethered stimulation tool from a wellhead into a tubular disposed in a wellbore at least partially filled with a wellbore fluid. The untethered stimulation tool can include a main body formed at least in part from a material that is buoyant in the wellbore fluid, a ballast, a magnet, and a pressure pulse generator. The untethered stimulation tool is configured to, when the ballast is attached to the untethered stimulation tool, descend downhole within the tubular by a force of gravity. The method further includes coupling the untethered stimulation tool by the magnet to an interior surface of the tubular upon arrival of the untethered stimulation tool at a downhole location proximate the perforation. When the untethered stimulation tool is coupled by the magnet to the interior of the tubular, a pressure pulse generator is activated to transmit pressure pulses into the perforation, thereby dislodging material from the perforation. The method also includes de-coupling the untethered stimulation tool from the interior surface and, after de-coupling, releasing the ballast, thereby permitting the untethered stimulation tool to ascend uphole, driven at least partially by a buoyant force exerted by the wellbore fluids. After releasing the ballast, the untethered stimulation tool is retrieved at the wellhead.

An aspect combinable with any of the other aspects can include the following features. The untethered stimulation tool can include a power boost circuit to charge a capacitor to switch a state of the magnet.

An aspect combinable with any of the other aspects can include the following features. The power boost circuit can power the pressure pulse generator.

An aspect combinable with any of the other aspects can include the following features. De-coupling the untethered stimulation tool can be by switching the magnet.

An aspect combinable with any of the other aspects can include the following features. Releasing the ballast can be by switching the magnet.

An aspect combinable with any of the other aspects can include the following features. The magnet can be a first magnet, and the untethered stimulation tool can further include a second magnet, and releasing the ballast can be by switching the second magnet.

An aspect combinable with any of the other aspects can include the following features. The untethered stimulation tool can also include a controller including a processor and a storage medium. The storage medium can include instructions to direct the processor to measure data correlating to a depth in the wellbore, release the ballast at a target depth, switch a state of the magnet, and activate the pressure pulse generator.

An aspect combinable with any of the other aspects can include the following features. The method can also include determining a depth of the untethered stimulation tool.

An aspect combinable with any of the other aspects can include the following features. The tubular can include a metallic wellbore casing.

An aspect combinable with any of the other aspects can include the following features. The pressure pulse generator can include a piezoelectric actuator.

DETAILED DESCRIPTION

A small, untethered stimulation tool (UST) for stimulating wellbore perforations and other near-wellbore areas is provided herein, along with a method for using the UST. The UST can be deployed at the wellhead by an individual in the field, without using logging crews, vehicles, or other specialized equipment. The UST can have a buoyant case and an attached ballast. The ballast can be sufficient to give the UST a negative buoyancy in the well fluids, allowing it to sink. At a suitable depth, a switchable magnet onboard the UST can be switched on, coupling the UST to a ferromagnetic component of the wellbore such as, for example, an interior surface of a metallic tubular such as a wellbore casing through which a perforation (such as a production perforation) has been formed. With the UST coupled at this location, a pressure pulse generator onboard the UST can be activated to dislodge mudcake and other particulate or non-particulate matter from the perforation and from pores, cavities, and spaces of the geological formation surrounding the perforation. After the stimulation operation is completed for that perforation, the switchable magnet can be switched back off to uncouple the UST from the casing, allowing the UST to sink further downhole to another perforation or perforated area. Once stimulation operations for all the desired perforations (or other areas) is completed, the ballast can be released, allowing the UST to float back up to the top of the wellbore for retrieval at the wellhead. In some embodiments, the ballast is attached to the UST by a second magnet, and the ballast release can be performed by switching the second magnet. In some embodiments, after the ballast is released but before retrieval, as the UST rises in the uphole direction, the first magnet can be switched on again to couple to the casing at another perforation or other area uphole of the initial perforation for stimulation operations at this uphole location, after which the magnet can be switched off again to allow the UST to continue to rise uphole for retrieval at the wellhead.

Figure 1:
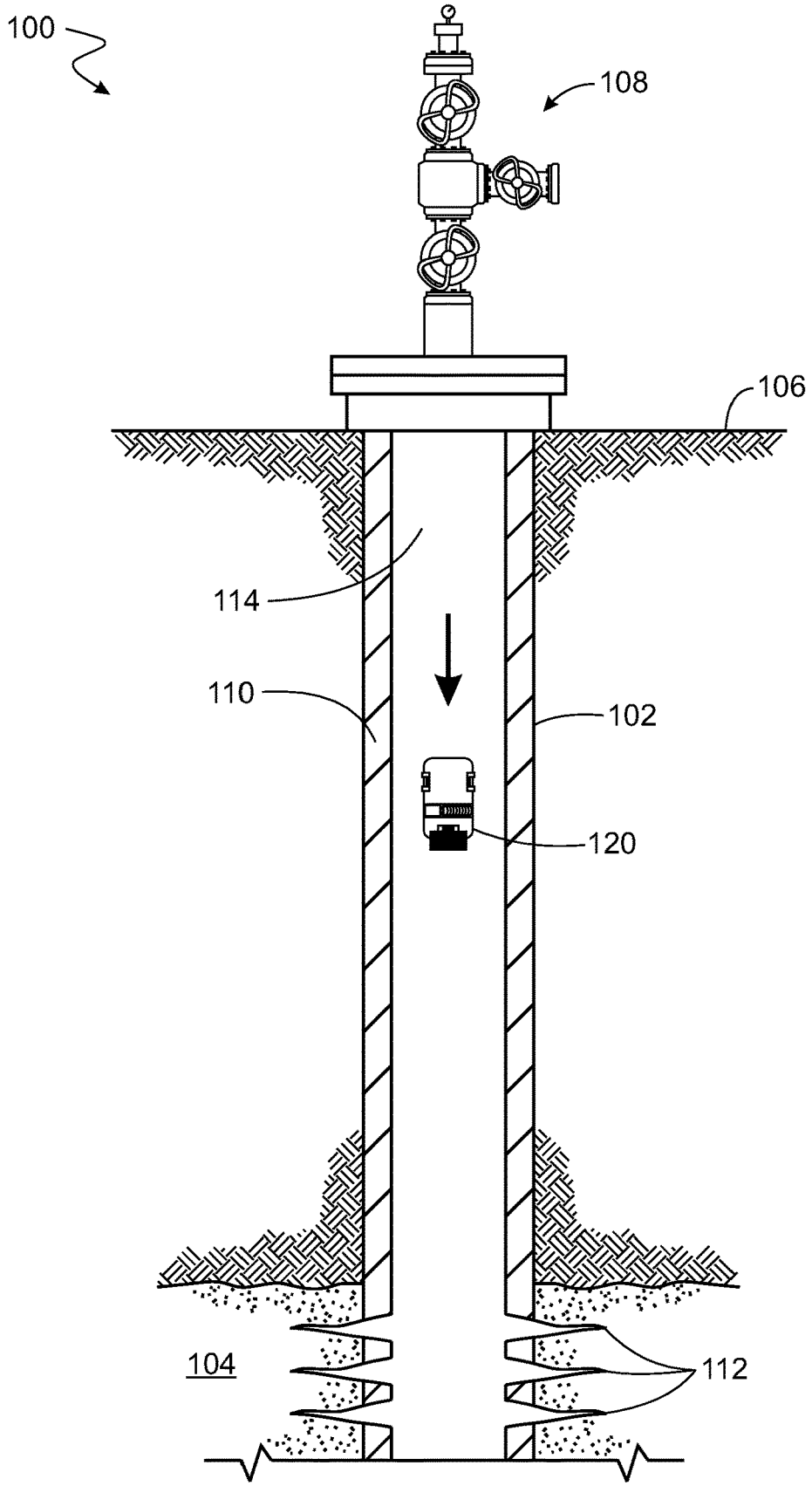
FIG. 1 is a schematic illustration of a wellbore system in accordance with some embodiments of the present disclosure.

FIG. 1 is a schematic diagram of a well system in accordance with an embodiment of the present disclosure. Referring to FIG. 1, well system 100 includes a wellbore 102 drilled into a subterranean zone 104 from surface 106. Wellbore 102 can be a wellbore of an oil and/or gas well, water well, or other wellbore drilled into subterranean zone 104 for purposes of oil and/or gas production or other purposes or applications, and can be drilled from a surface (land) location or an offshore location. Wellbore 102 in the illustrated embodiment is substantially vertical; however, in some embodiments the wellbore can include both vertical and other-than-vertical (such as substantially horizontal) portions, and can comprise a single wellbore or can include multiple lateral wellbores. Well system 100 further includes a wellhead 108 which can include various spools, valves, and adapters to provide pressure and flow control from wellbore 102.

In the illustrated embodiment, casing 110 has been installed and cemented in place within wellbore 102 to stabilize the wellbore in accordance with conventional methods. Wellbore 102 can be filled by a wellbore fluid 114, such as produced fluids, completion fluids, or another suitable fluid or mixture of fluids.

To provide a pathway for oil, gas, or other materials to be produced from subterranean zone 104 to enter wellbore 102, perforations 112 have been formed through casing 110 and into subterranean zone 104. Perforations 112 can be formed, for example, via shaped explosive charges or other means. In some circumstances, perforations 112 and/or the pores in the geological formation surrounding perforation 112 can become blocked or clogged by sediment, mudcake, or other particulate or nonparticulate materials.

In the illustrated embodiment, an untethered stimulation tool (UST) 120 has been disposed in wellbore 102. A UST in accordance with some embodiments of the present disclosure is described in greater detail in FIG. 2 and, in some embodiments, can be inserted into the wellbore via valves in wellhead 108 as described in reference to FIGS. 10A-10C.

Figure 2:
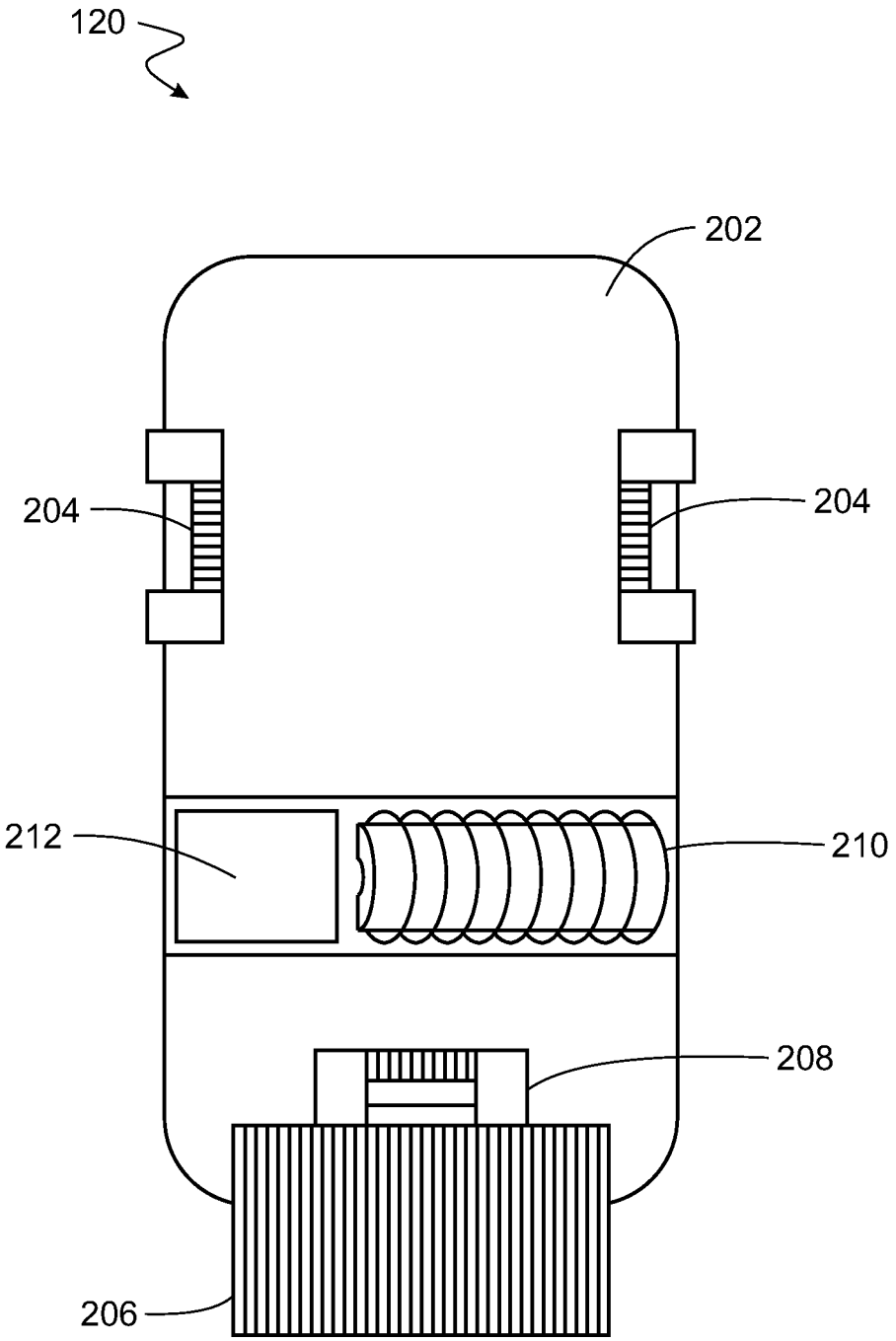
FIG. 2 is a schematic illustration of an untethered stimulation tool in accordance with some embodiments of the present invention.

FIG. 2 is a schematic illustrations showing UST 120 in greater detail in accordance with some embodiments of the present disclosure. Referring to FIG. 2, UST 120 includes a main body 202, formed at least in part from a material that is buoyant in a wellbore fluid. The buoyant material can be or can include a hydrocarbon resistant polymer, such as a polypropylene foam or a polyurethane foam. The buoyant material provides the UST 120 with a total density that is lower than the density of the fluids known or expected to be in the wellbore.

UST 120 further includes one or more switchable magnets 204 configured to, when switched on, couple UST 120 to a ferromagnetic surface such as an interior surface of a casing or other tubular disposed in a wellbore. A magnet 204 is described in greater detail in reference to FIG. 6.

UST 120 further includes a ballast 206 coupled to main body 202 by a second switchable magnet 208. In other embodiments, ballast 206 can be coupled to main body 202 by a releasable mechanical means, or by a dissolvable material. In some embodiments, ballast 206 can itself be comprised of a dissolvable material. In some embodiments, ballast 206 is coupled to main body 202 not by a second switchable magnet but instead by the same switchable magnet (for example, one or more of magnets 204) configured to couple UST 120 to the casing or other tubular.

UST 120 further includes a pressure pulse generator 210 configured to, when activated, transmit pressure pulses from UST into a perforation or another volume or area proximate UST 120, when UST 120 is coupled to the casing or other surface. In some embodiments, pressure pulse generator 210 can comprise a compact piezoelectric actuator. A suitable piezoelectric actuator in some embodiments is a PL0xx PICMA linear piezoelectric actuator available from Physik Instrumente L.P. of Auburn, Massachusetts. Such an actuator can have dimensions of 2 mm×2 mm×2 mm and can provide forces of up to 2000 N, with an operational range is −20 to 100 V powered by a battery and booster circuit disposed within UST 120.

UST 120 can further include a controller 212 which can control the magnets, pressure pulse generator, and other components of UST 120, and can be programmed as described below. UST 120 can further include one or more pressure sensors and/or one or more casing collar locators for determining the depth of UST 120, and these sensors and/or locators can likewise be monitored and controlled by controller 212. Controller 212 is described in greater detail in FIG. 9.

Figure 3:
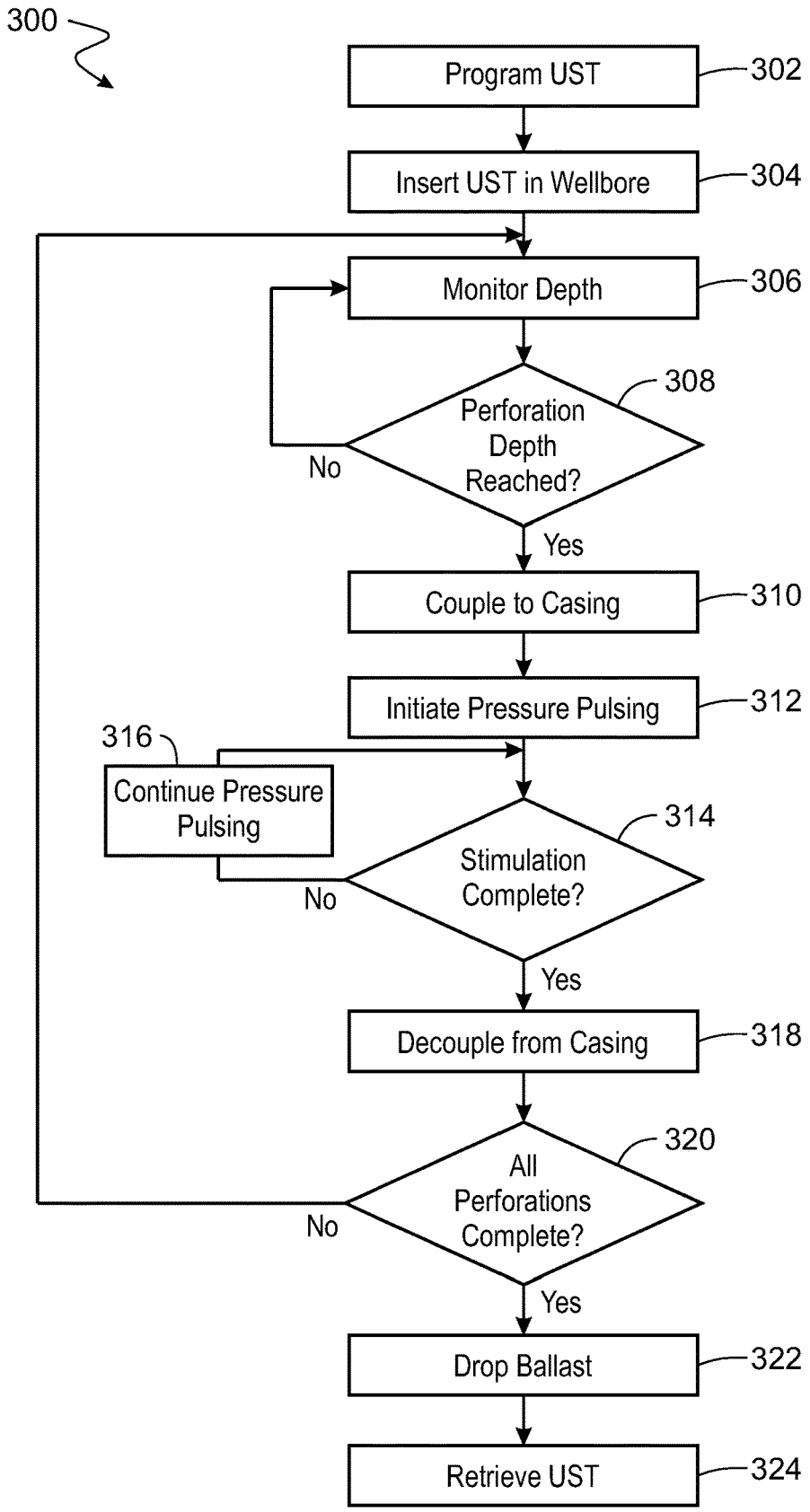
FIG. 3 is a process flow diagram of a method for near-wellbore stimulation using an untethered stimulation tool in accordance with some embodiments of the present invention.

FIG. 3 is a process flow diagram of a method 300 for near-wellbore stimulation using an untethered stimulation tool in accordance with some embodiments of the present invention. The steps of method 300 are described in reference to FIGS. 4A-4E and 5A-5B.

Method 300 begins with step 302 in which the UST is programmed for operations. The programming can include programming the UST with one or more target depths, which can correspond to the depths of the perforation or perforations targeted for stimulation. Depth can in turn be determined based on pressure measurements from onboard pressure sensors. The programming can also include programming the UST with a release condition to trigger the release of the UST from the metallic surface. In some embodiments, the release condition is based on a time measurement, for example, after a pre-determined duration of stimulation (pressure-pulsing) operations. The programming can also include a ballast release condition, can be based, at least in part, on depth, completion of pressure-pulsing operations, or another suitable parameter.

Figure 4A:
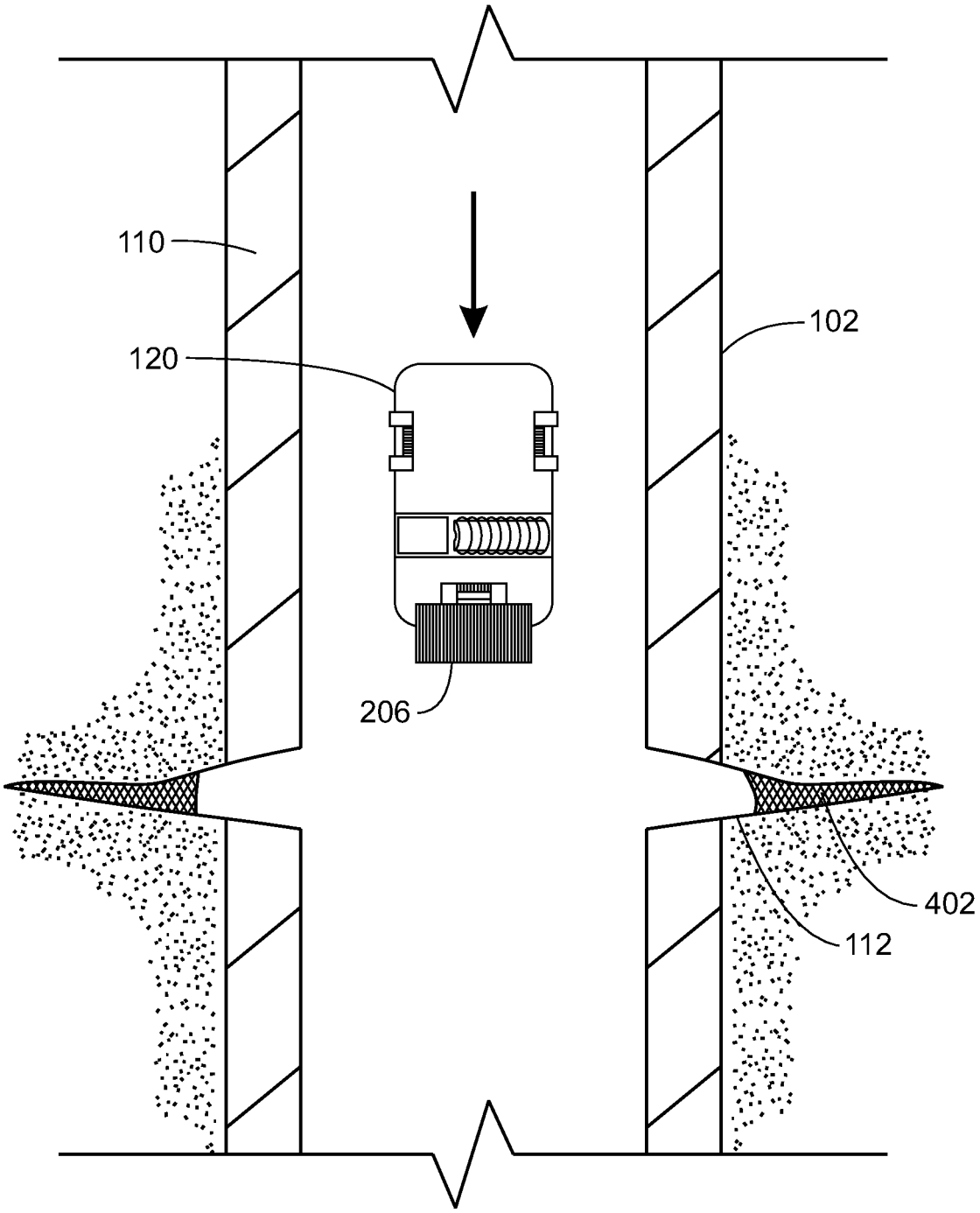
FIGS. 4A-4E are schematic illustrations of a near-wellbore stimulation using an untethered stimulation tool in accordance with some embodiments of the present invention.
Figure 4B:
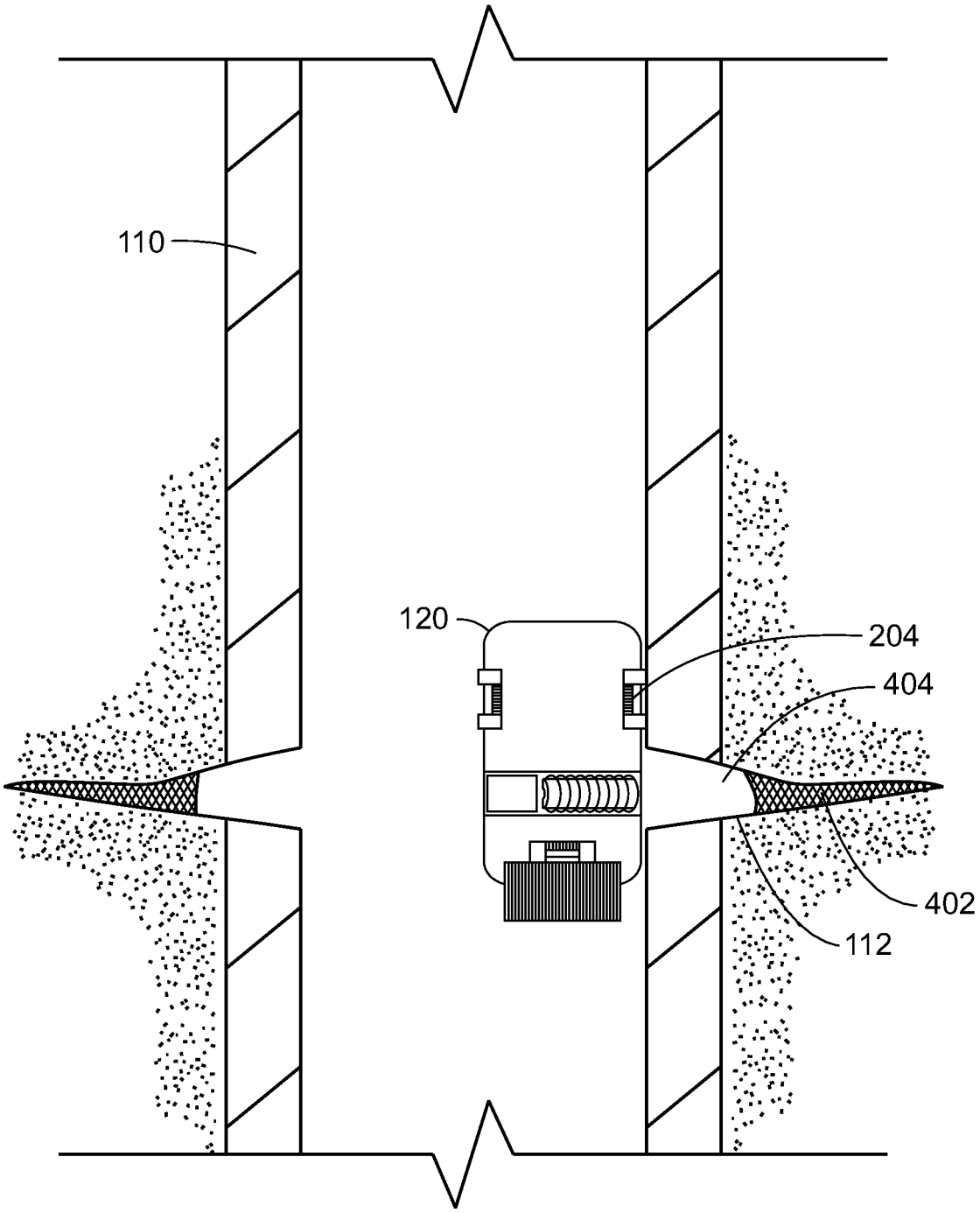

At step 304, the UST is inserted into the wellbore. In some embodiments, such insertion is through a wellhead as described below in reference to FIGS. 10A-10C. As the UST descends downhole, as shown in FIG. 4A, propelled by the force of gravity, depth is measured at step 306. If at step 308, the target depth (such as the depth of a perforation 112 with materials 402 targeted for removal by stimulation operations) has not been reached, depth continues to be measured as the UST continues to descend. If at step 308 the target depth has been reach, then, at step 310, and as shown in FIG. 4B, magnet 204 is switched so as to couple the UST to the interior surface of the casing.

Figure 4C:
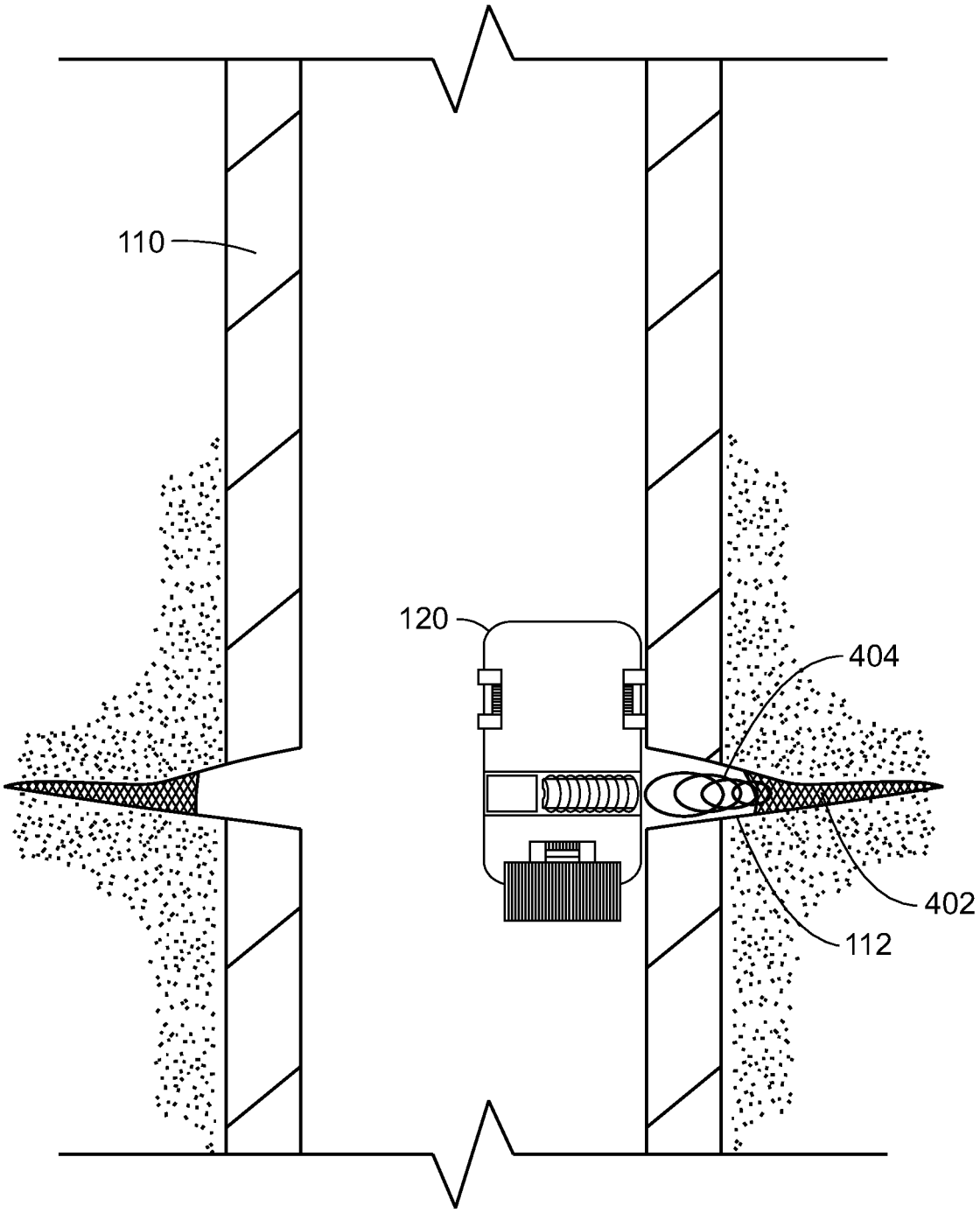

At step 312, stimulation operations commence by pressure pulsing from the pressure pulse generator 210, as shown in FIG. 4C. For example, in embodiments wherein pressure pulse generator 210 is a piezoelectric actuator operated in proximity to perforation 112, the pressure waves would create shock motion in wellbore fluid near the perforation. The perforation and the materials within would encounter alternating positive and negative differential pressure, causing undesirable materials to dislodge from the perforation.

Per steps 314 and 316, pressure pulsing continues until the pressure pulsing operations are complete. In some embodiments, suitable or optimal pulsing time duration and intervals could be determined using modeling or laboratory experiments, prior to deployment of the tool. In some embodiments, a safety factor of 20% to 30% could be added to the estimated durations or intervals.

Figure 4D:
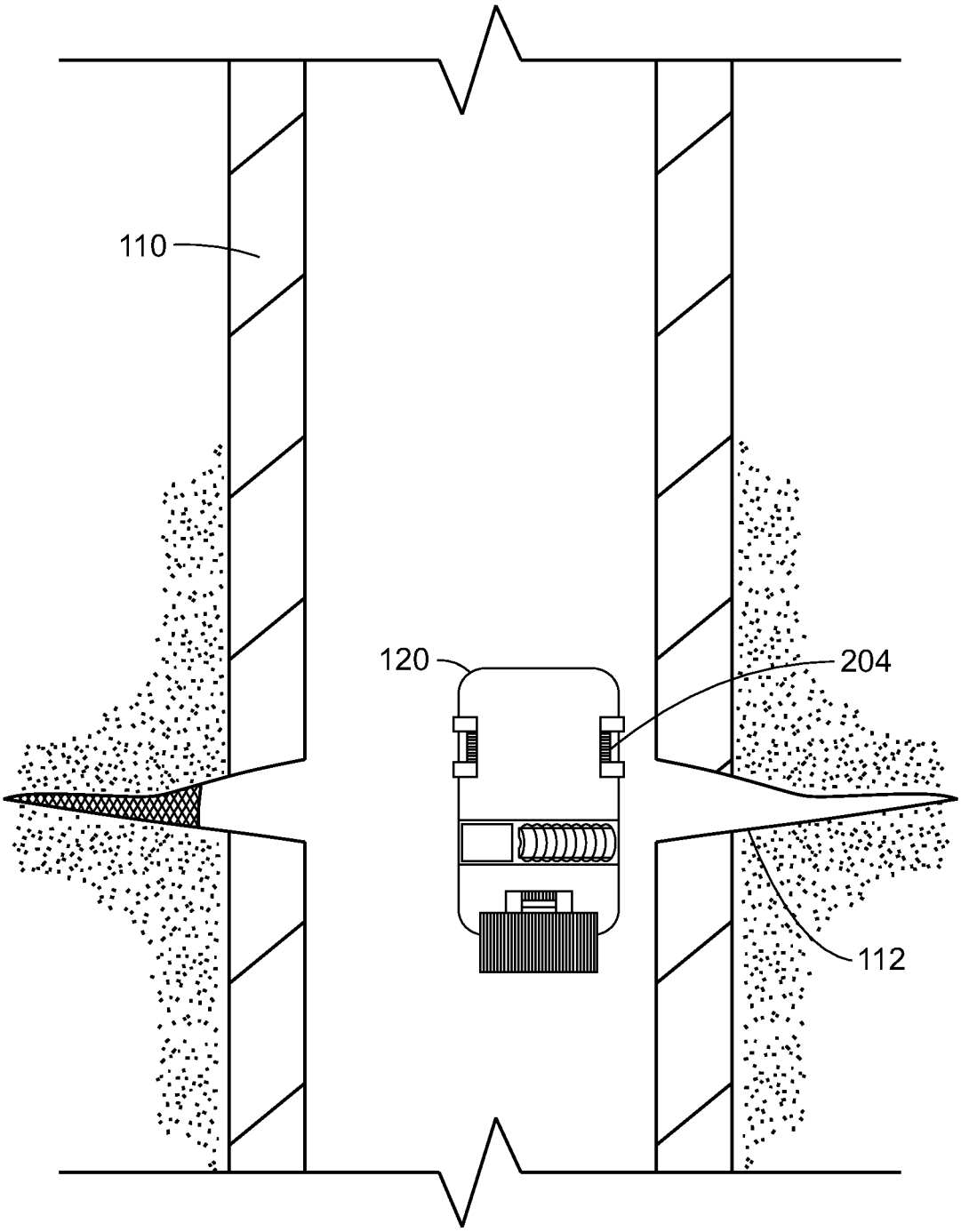
Figure 4E:
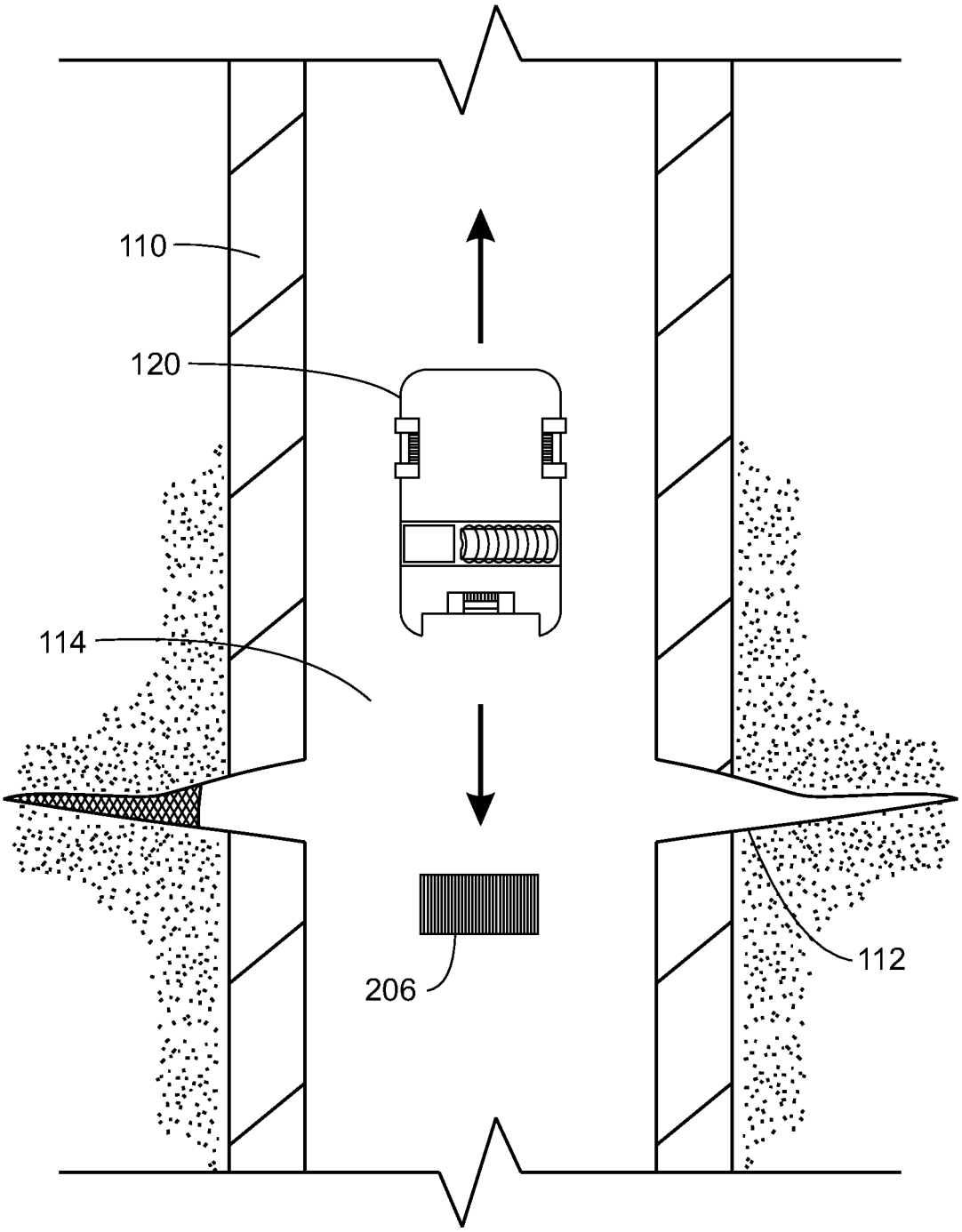

If at step 314 the stimulations operations are complete, then the method proceeds to step 318 in which magnet 204 is switched to decouple the UST from the casing, as shown in FIG. 4D. If at step 320 there are no further perforations for which stimulation is desired, then the method proceeds to step 322 in which, as shown in FIG. 4E, ballast 206 is released from the UST and the UST can ascend uphole driven by the buoyant force exerted by wellbore fluids 114, for retrieval at the wellhead at step 324.

Figure 5A:
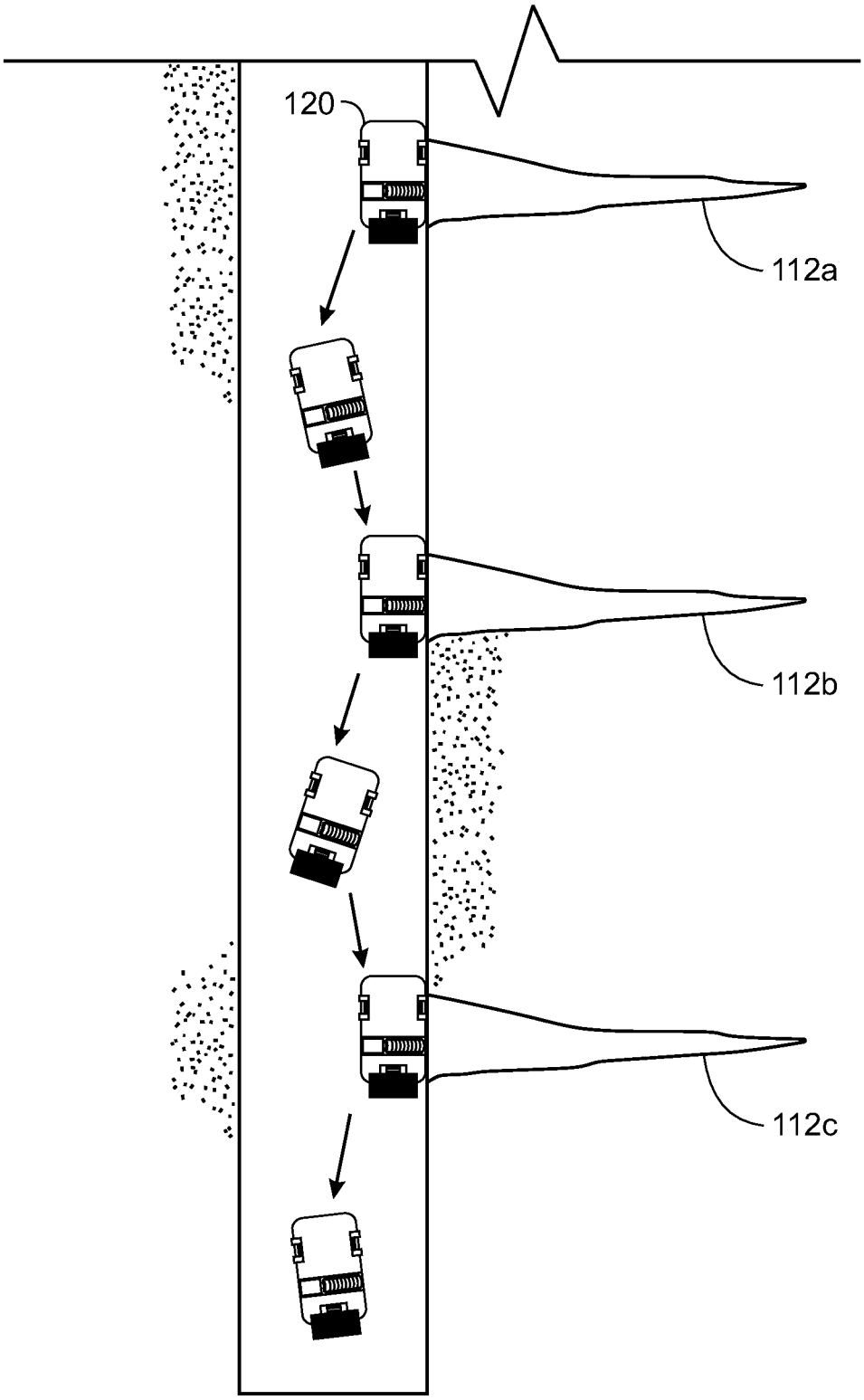
FIG. 5A is a schematic illustrations of a near-wellbore stimulation using an untethered stimulation tool in accordance with some embodiments of the present invention.
Figure 5B:
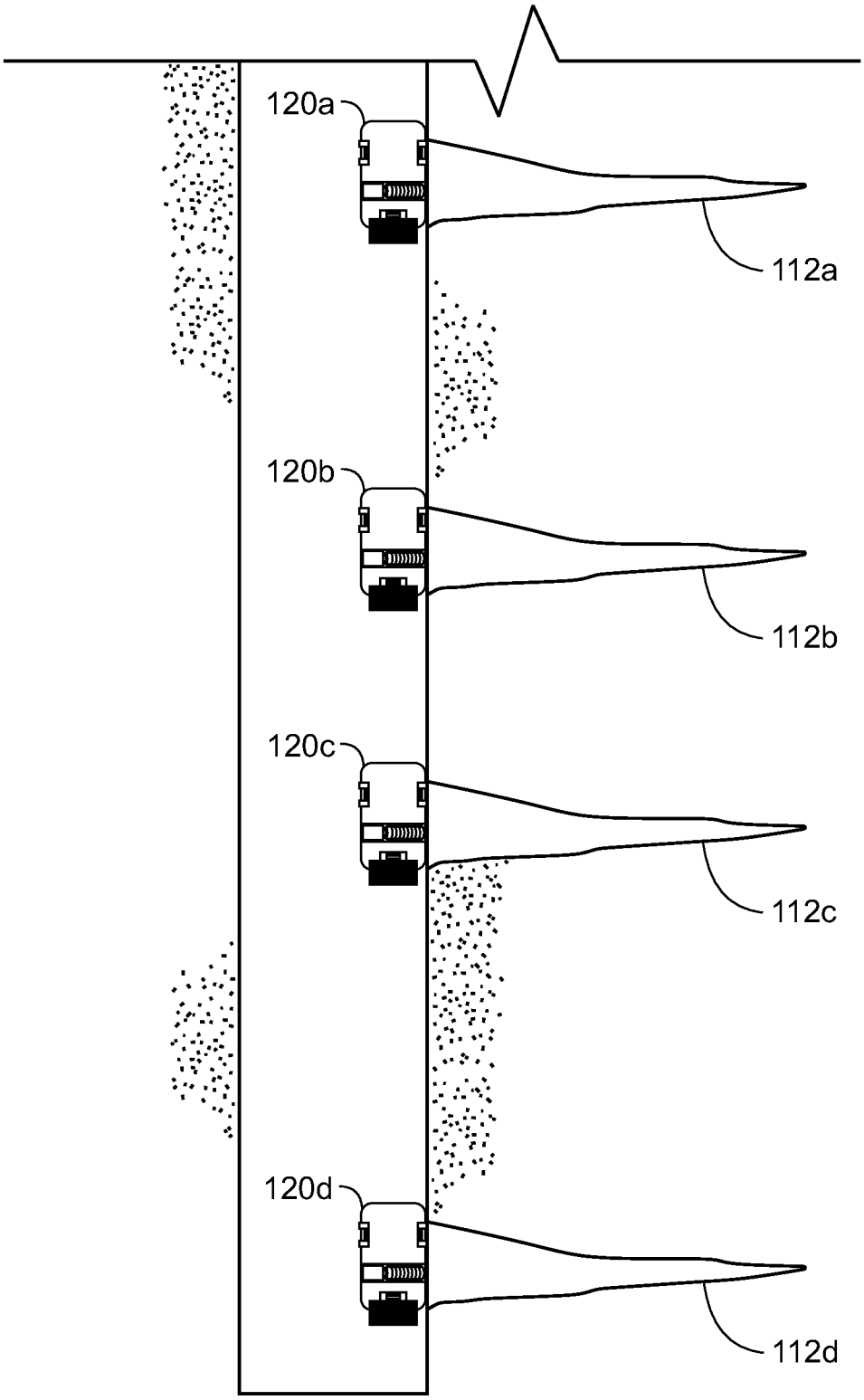
FIG. 5B is a schematic illustrations of a near-wellbore stimulation using multiple untethered stimulation tools in accordance with some embodiments of the present invention.

If at step 320, as shown in FIG. 5A, there are additional perforations for which stimulation operations are desired, then, instead of releasing the ballast at that time, the UST continues to descend downhole after release from the casing wall to the next perforation, and returns to step 306 for further stimulation operations. In some embodiments, the subsequent perforations may be uphole of the initial perforation, such that the UST is coupled to the casing at such uphole perforations after release of the ballast. In some embodiments, as shown in FIG. 5B, multiple USTs can be deployed to stimulate the multiple perforations.

Figure 6:
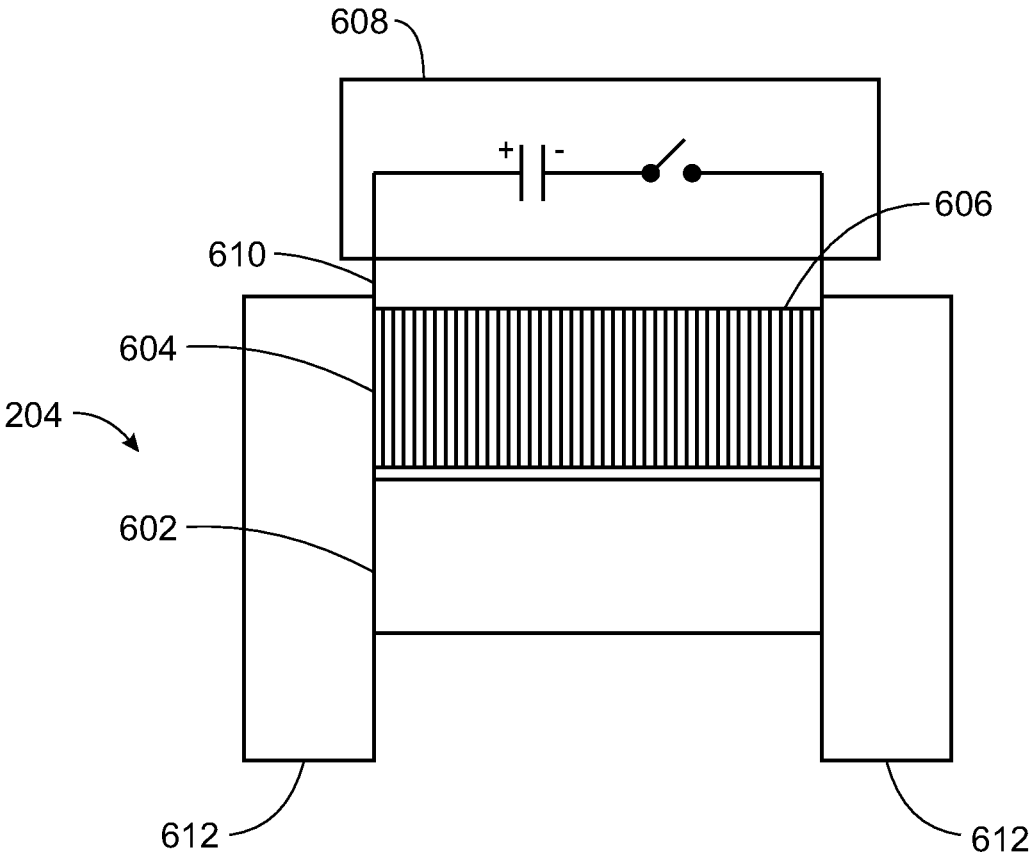
FIG. 6 is a cross-sectional diagram of a switchable magnet in accordance with an embodiment of the present disclosure.

FIG. 6 is a cross-sectional diagram illustrating switchable magnet 204 of FIG. 2 in accordance with some embodiments of the present disclosure. The same or similar magnet design and configuration as shown in FIG. 6 can also be utilized for the ballast-releasing magnet 208 of FIG. 2. In other embodiments, switchable magnet 204 and 208 can have different designs or configurations.

Switchable magnet 204 can include two permanent magnets 602 and 604 connected in parallel. One of the permanent magnets 602 can be made of a material that has a higher coercivity or resistance to having its magnetization direction reversed, for example, samarium cobalt (SmCo), among others. A second permanent magnet 604 can be made of a material that has a lower coercivity or resistance to having its magnetization direction reversed, and therefore can have its polarization direction changed easily, for example, aluminum nickel cobalt (AlNiCo, Alnico V), among others. The size and material of the two permanent magnets 602 and 604 is selected so that they have essentially the same magnetic strength, i.e., remnant magnetization.

In one embodiment, a coil of wire 606 is wrapped around the lower coercivity magnet, i.e. the second permanent magnet 604. In another embodiment, a coil may be wrapped around both magnets, since the higher coercivity magnet is chosen such that it will not be repolarized by the field produced by the coil of wire 606. In another embodiment, there are an even number of magnets, e.g., two, four, or more, all of the same low coercivity material (such as AlNiCo) and the same dimensions. The coil of wire 506 is wrapped around half of the magnets, such that only half of the magnets have polarization switched by the coil. Making all magnets of the same low coercivity material simplifies the matching of the magnetic strength of the repolarized and unrepolarized magnets. This helps to ensure field cancellation in the polarization or off state, as a failure to completely cancel the fields in the polarization state may result in a failure to decouple from a surface, such as the ballast.

Figure 7:
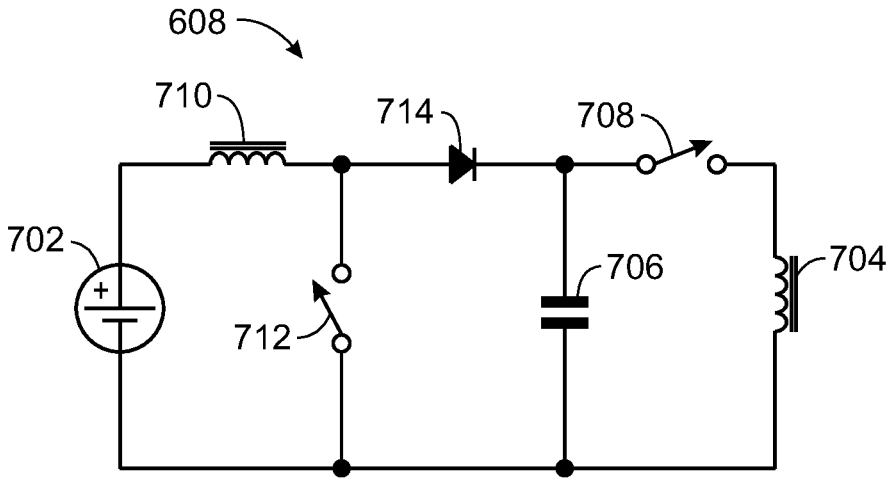
FIG. 7 is a schematic diagram of a boost circuit in accordance with some embodiments of the present disclosure.
Figure 8:
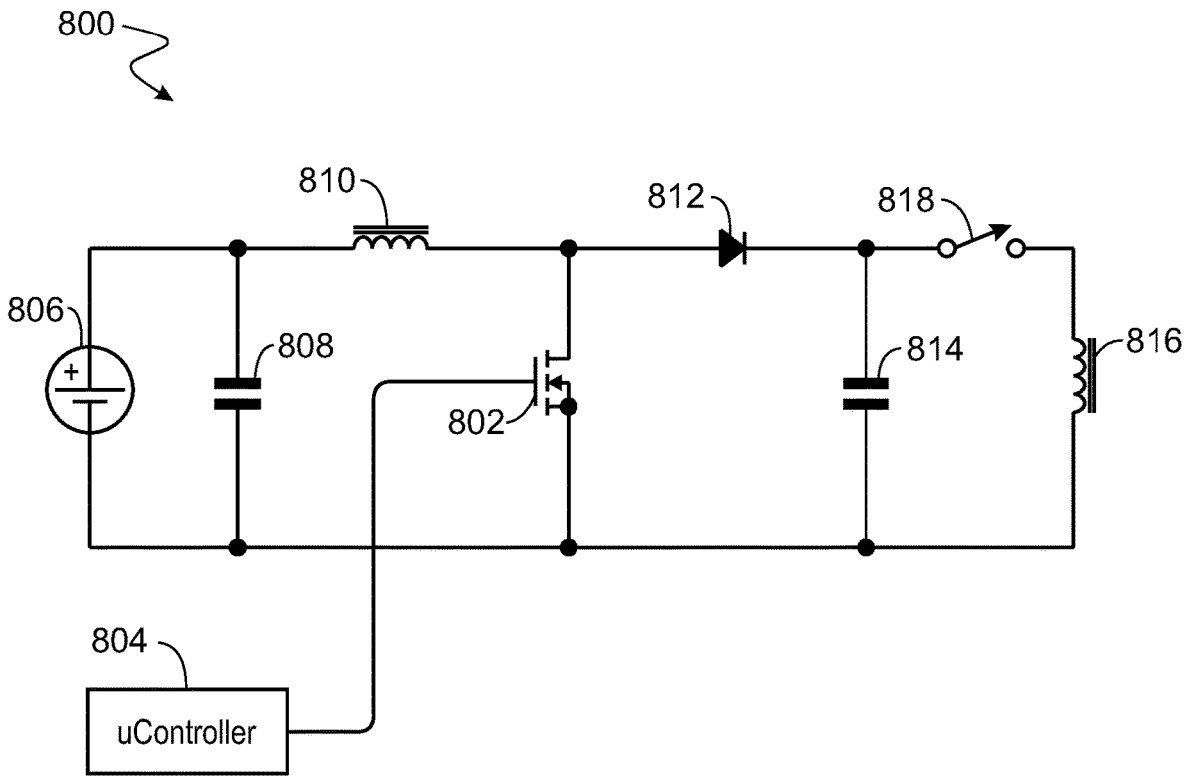
FIG. 8 is another example of a boost circuit that uses a switch with a modulated control signal from a controller in accordance with some embodiments of the present disclosure.

As the battery may not provide the voltage and current needed to power the repolarization, a boost circuit 608, as described further with respect to FIGS. 7 and 8, can provides the power to switch the switchable magnet between an external flux or on state and an internal flux or off state. The power is provided from the boost circuit through leads 610 attached to the coil of wire 606. When a short pulse, or sequence of pulses, of a large electrical current is applied to the coil of wire 606 in a first direction, it permanently polarizes the lower coercivity magnet, e.g., the second permanent magnet 604. In some embodiments, the pulse or each of the pulses is about 200 microseconds in duration, at a current of about 20 amps. In an embodiment, this orients the flux lines in the same direction as the higher coercivity magnet, e.g., the first permanent magnet 602. This is described herein as the external flux or on state in which the magnetic flux lines run through flux channels 612, attached to the permanent magnets 602 and 604, to the outside of the UST. In some embodiments, the flux channels 612 are made of a material having a high magnetic permeability, such as iron. In the on state, a UST can couple to a ferromagnetic surface, such as the ballast or the metallic casing of a wellbore.

A pulse or pulse sequence applied to the coil of wire 606 in a second direction reverses the polarization of the low coercivity magnet, e.g., the second permanent magnet 604, in the opposite direction from the high coercivity magnet, e.g., the first permanent magnet 602. This is described herein as the internal flux or off state, as the magnetic flux travels in a loop through the two permanent magnets 602 and 604 and through the flux channels 612, but does not substantially extend outside the untethered stimulation tool. This allows the untethered device to decouple from a ferromagnetic surface ascend within the wellbore.

FIG. 7 is a schematic diagram of a boost circuit 608. Typically a small battery 702, e.g. less than 1 $cm^3$, used to power a miniaturized tool cannot supply more than a few milliamps of current, therefore, there is a need for amplification for powering the load or coil 704. For example, the boost circuit 608 can be used to charge a capacitor 706 of size several tens of microfarads to a relatively high voltage, e.g. in the range of 40-100 V. The stored charge can be released over the coil 704 to provide the desired current amplitude by triggering a switch 708. The size of the capacitor 706 and voltage charge level are selected based on the inductance of the coil 704 which is defined by the material of the magnet and the size of the magnet, e.g., radius, length, and the like, and the number of wire turns. For example, a 15 microFarad (μF) capacitor charged to 100 V can generate 20-25 A of current on a coil with 40 turns wrapped around an AlNiCo-V magnet with 3/16" diameter and a ½ " length.

The boost circuit 608 of FIG. 7 has an inductor 710 that boosts the voltage and amperage as a switch 712, such as a power MOSFET, is sequentially turned on and off using a control signal. e.g., a pulse train, from the electronics package. A blocking diode 714 is used to force current to flow from the capacitor 706 through the coil 704 when the switch 712 is open.

A pulse train can be used as the control signal to the switch 712. For example, switch 712 is closed for 2 μs and opened 18 μs periodically. When switch 712 is closed, a large current is drawn through the inductor 710. As the switch is opened, the large current on the inductor 710 is pushed towards the capacitor 706, resulting in charge accumulation. This process is repeated until the desired voltage is reached at the capacitor 706, which flows through the coil 704 reversing, or enhancing, the polarity of the magnet.

FIG. 8 is another example of a boost circuit 800 that uses a switch 802 with a modulated control signal from a controller 804, in accordance with some embodiments. In some embodiments, boost circuit 800 of FIG. 8 can be utilized for the magnet 204 of FIGS. 2 and 6 in lieu of boost circuit 608. Due to limited current supply of small size batteries, such as battery 806, to boost up voltages as high as 100 V for providing power may require additional strategies. In contrast to batteries, capacitors can supply large amount of currents for a short time. In one embodiment, an input capacitor 808, for example, with a capacitance of 300 μF, is placed in parallel with the battery 806. In this embodiment, the battery 806 supplies a small current and charges the input capacitor 808 over a relatively long time. The input capacitor 808 then supplies a larger current to the boost circuit 800 over a shorter time.

As with the boost circuit shown in FIG. 7, the boost circuit 800 uses an inductor 810, a blocking diode 812, and an output capacitor 814 to provide a higher voltage to the load, e.g., coil 816, when a power switch 818 is closed. In this example, the inductor 810 has an inductance of about 6.8 microHenry (μH). The output capacitor 814 has a value of about 15 μF. The higher voltage output is generated by modulating a signal from the controller 804 to the switch 802, as discussed further with respect to FIG. 9. The controller 804 may be as described with respect to the controller 1302 of FIG. 13. In some embodiments, a modulated switch input signal that may be used with the boost circuit. The modulated control signal to the switch 802 allows the input capacitor 808 to be recharged once it has been depleted. For example, the switch 802 can be periodically opened and closed at short periods for some time (e.g., closed 2 μs and opened 18 μs for 2 ms) for powering the boost circuit. During this time, the input capacitor 808 provides a relatively high current that cannot be directly sourced from the battery. Then, the switch 802 stays open for some time (e.g. 8 ms) to allow recharging the depleted input capacitor 808 from the battery 806. In other words, a first pulse train with a shorter period applied to the switch 802, is modulated with a second pulse train that has a longer period (e.g. 100 times longer than the first pulse train's period) in order to stop the boost circuit and allow recharging of the input capacitor 808.

Figure 9:
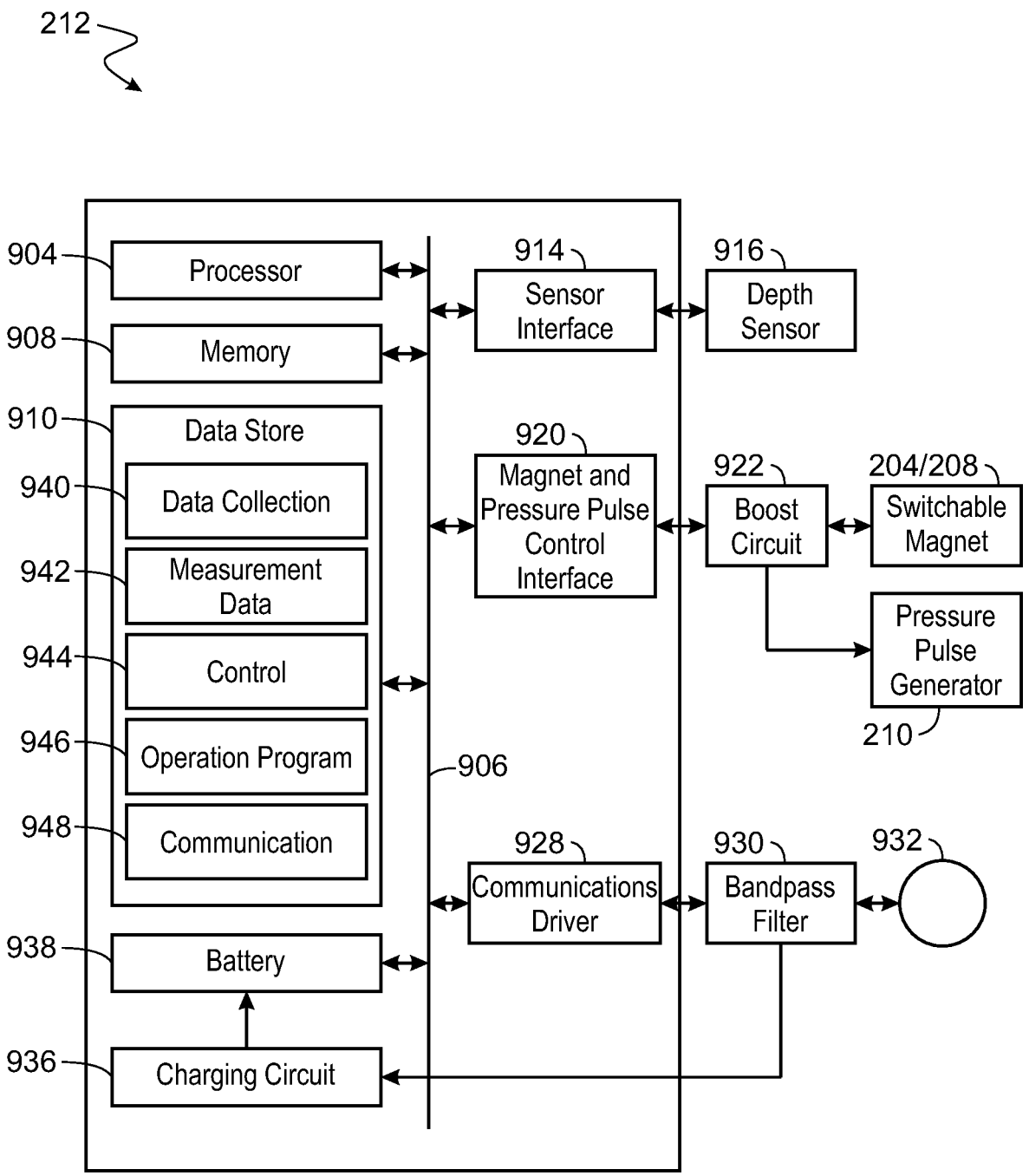
FIG. 9 is a block diagram of a controller of an untethered stimulation tool in accordance with some embodiments of the present disclosure.

FIG. 9 is a block diagram of showing controller 212 of FIG. 2 in relation to the other the operational components of UST 120 in accordance with some embodiments of the present invention. In the embodiment shown in FIG. 9, controller 212 includes a processor 904. The processor 904 may be a microprocessor, a multi-core processor, a multi-threaded processor, an ultra-low-voltage processor, or an embedded processor. In some embodiments, the processor 904 may be part of a system-on-a-chip (SoC) in which the processor 904 and the other components of the controller 212 are formed into a single integrated electronics package. In various embodiments, the processor 904 may include processors from Intel® Corporation of Santa Clara, California, from Advanced Micro Devices, Inc. (AMD) of Sunnyvale, California, or from ARM Holdings, LTD., Of Cambridge, England. Any number of other processors from other suppliers may also be used.

The processor 904 may communicate with other components of the controller 212 over a bus 906. The bus 906 may include any number of technologies, such as industry standard architecture (ISA), extended ISA (EISA), peripheral component interconnect (PCI), peripheral component interconnect extended (PCIx), PCI express (PCIe), or any number of other technologies. The bus 906 may be a proprietary bus, for example, used in an SoC based system. Other bus technologies may be used, in addition to, or instead of, the technologies above.

The bus 906 may couple the processor 904 to a memory 908. In some embodiments, such as in microcontrollers, programmable logic controllers, and the like, the memory 908 is integrated with a data store 910 used for long-term storage of programs and data. The memory 908 include any number of volatile and nonvolatile memory devices, such as volatile random-access memory (RAM), static random-access memory (SRAM), flash memory, and the like. In smaller devices, such as microcontrollers, the memory 908 may include registers associated with the processor 904 itself. The data store 910 is used for the persistent storage of information, such as data, applications, operating systems, and so forth. The data store 910 may be a nonvolatile RAM, a solid-state disk drive, or a flash drive, among others.

The bus 906 couples the processor 904 to a sensor interface 914. The sensor interface 914 connects the controller 212 to the sensors used to measure data in the UST 120 such as depth sensor 916 which can comprise a pressure sensor and/or a casing collar locator. In some embodiments, the sensor interface 914 is a bank of analog-to-digital converters (ADCs), an $I^2C$ bus, or a serial peripheral interface (SPI) bus, among others. In some embodiments, the pressure sensor is a Wheatstone bridge using carbon film resistors on two legs and metal film resistors on the opposite two legs. As carbon film resistors change resistance when pressure changes, the pressure is measured as the difference in resistance between the two legs. In some embodiments, the temperature sensor is a thermocouple.

The bus 906 also couples the processor 904 to a magnet and pressure pulse control interface 920 that is used to control the boost circuit 922 for powering the repolarization of the switchable magnets 204 and/or 208 and also pressure pulse generator 210. In some embodiments, the control interface 920 is a bank of relays, or a bank of MOSFET power controllers, among others. The control interface 920 may also include an ADC to monitor the voltage on the output capacitor, Cout, which is part of the boost circuit 922. The control interface 920 can provide power and the control signal, or control signals, to the boost circuit 922, which may be as described with respect to the boost circuits 608 and 800 of FIGS. 7 and 8. In some embodiments, the system is configured such that the operation of pressure pulse generator 210 commences after the magnet 204 has been polarized for a specified amount of time. The operation sequence can be programed in the data store 910 (described further below).

The bus 906 also couples the processor 904 to a communications driver 928. In some embodiments, the communications driver is a digital interface, such as an SPI bus, and $I^2B$ bus, or a digital bit interface that powers a RFI transceiver. In the embodiment shown in FIG. 9, the communications driver 928 couples to a bandpass filter 930. The bandpass filter 930 is coupled to a radio loop antenna 932. The radio loop antenna 932 may include, for example, a coil, planar spiral antenna, or a helical antenna. The bandpass filter 930 may couple higher frequencies signals, such as greater than about 50 kHz, 100 kHz, or higher, between the communications driver 928 and the radio loop antenna 932. The radio loop antenna 932 can be used to wirelessly program the UST 120 and to transfer stored data from the UST 120 to an interrogator. Lower frequency signals, such as one kHz, 500 Hz, or 100 Hz, or lower, may be directed by the bandpass filter 930 to a charging circuit 936 to wirelessly charge a battery 938.

Although the communications for the UST 120 are shown as radiofrequency communications through a radio loop antenna 932, it may be understood that other communications techniques may be used. In some embodiments, the communications driver is a serial interface, for example, USB, SPI, or I2C, among others. In these embodiments, the bandpass filter 930 is replaced with a hardware plug, for example, that is waterproof, or protected with a cover. In some embodiments, the communications driver is an optical transceiver, and the bandpass filter 930 is replaced with a paired phototransistor and light emitting diode (LED). In these embodiments, a charging antenna may be used to charge the battery, for example, coupled directly to the charging circuit 936.

The data store 910 includes blocks of stored instructions that, when executed, direct the processor 904 to implement the functions of the controller 212. The data store 910 includes a block 940 of instructions to direct the processor to collect data from the sensors 916 and store the data collected in a block dedicated for data storage.

The data store 910 includes a block 944 of instructions to direct the processor 904 to change the state of the switchable magnets 204 and/or 208 between the on state and the off state. For example, the instructions may direct the processor 904 to monitor the voltage on the output capacitor for the boost circuit, and maintain the charge at sufficient levels to repolarize one of the magnets in the switchable magnets. Block 944 can further include instructions to direct the operation of pressure pulse generator 210 after each instance that the switchable magnet 204 has been switched on. This instruction may also include an interval of operation for the pressure pulse generator, which can be modified by the user.

After this defined interval have passed, the pressure pulse generator will be switched off.

The data store 910 also includes a block of instructions to direct the processor 904 to implement an operational program 946 while the UST 120 is in the wellbore. The operational program may include the processes described herein.

The data store 910 includes a block 948 of instructions to direct the processor 904 to communicate through the communications driver 928 and the radio loop antenna 932 with an external computer. The instructions may direct the processor to store instructions provided to the UST 120 as the operational program 946 and to download data from the data store 942 to the external computer.

Figure 10C:
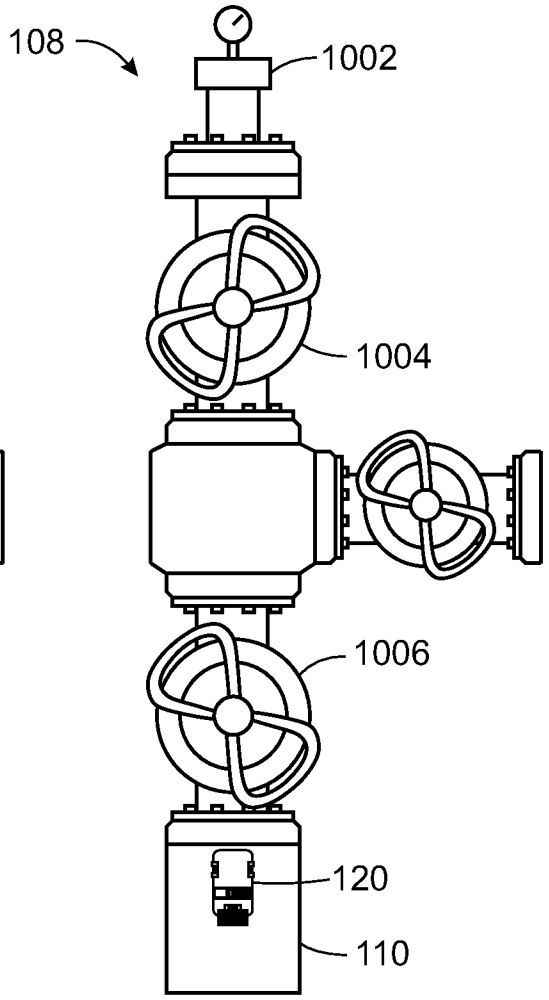
FIGS. 10A-10C are schematic illustrations showing insertion of an untethered stimulation tool through a wellhead in accordance with some embodiments of the present disclosure.
Figure 10B:
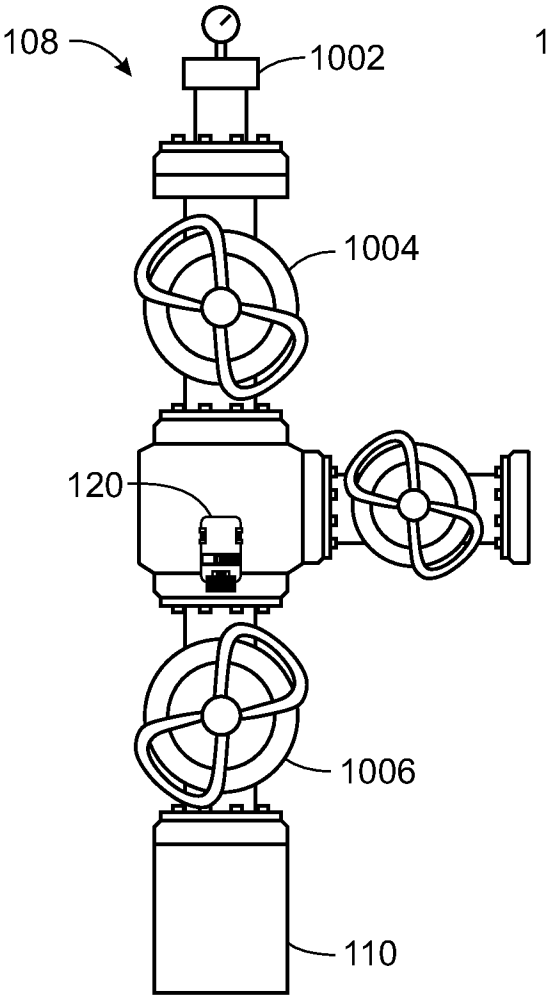
Figure 10A:
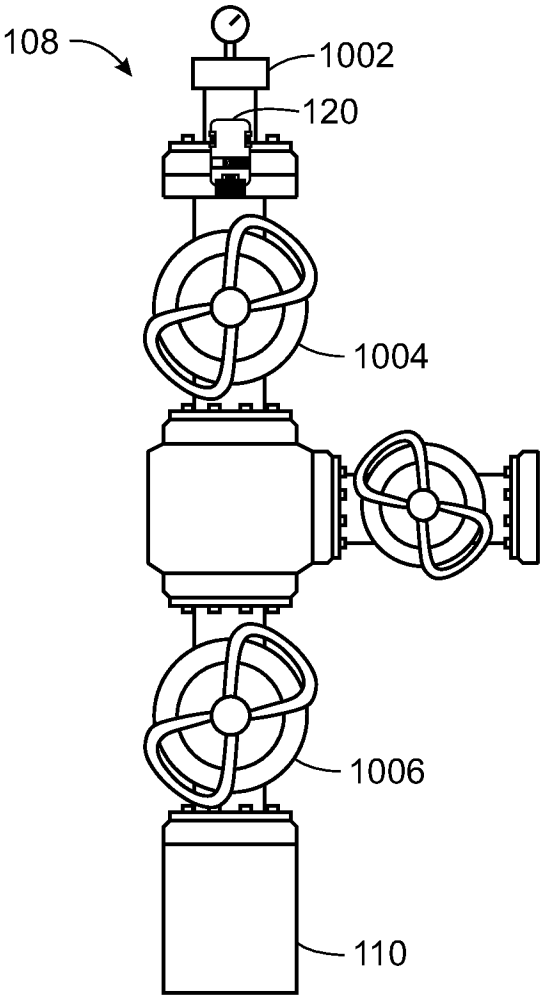

FIGS. 10A-10C illustrate insertion of UST 120 within casing 110 via wellhead 108 in accordance with embodiments of the present disclosure. As shown in FIG. 10A, the well tree cap 1002 is removed while both the crown valve 1004 and master valve 1006 are completely closed, and UST 120 is inserted into the wellhead. Next, as shown in FIG. 10B, the tree cap 1002 replaced and crown valve 1004 opened so as to allow UST 120 to descend into the volume between crown valve 1004 and master valve 1006. Next, as shown in FIG. 10C, crown valve 1004 is closed and master valve 1006 is opened, allowing UST 120 to descend downhole within casing 110.

The term "uphole" as used herein means in the direction along a wellbore from its distal end towards the surface, and "downhole" as used herein means the direction along a wellbore from the surface towards its distal end. A downhole location means a location along a wellbore downhole of the surface.

What is claimed is:

1. An untethered stimulation tool for dislodging material from a perforation formed through a tubular disposed in a wellbore, the untethered stimulation tool comprising:
- a main body, wherein the main body is formed at least in part from a material that is buoyant in a wellbore fluid;
- a ballast;
- a magnet; and
- a pressure pulse generator, wherein the untethered stimulation tool is configured to:
  - by a force of gravity when the ballast is attached to the untethered stimulation tool, descend from a wellhead downhole within the tubular;
  - couple, by the magnet, to an interior surface of the tubular upon arrival of the untethered stimulation tool at a downhole location proximate the perforation;
  - when the untethered stimulation tool is coupled by the magnet to the interior of the tubular, transmit pressure pulses from the pressure pulse generator into the perforation, thereby dislodging material from the perforation; and
  - de-couple from the interior surface and release the ballast, thereby permitting the untethered stimulation tool to ascend uphole, driven at least partially by a buoyant force exerted by the wellbore fluids.

2. The untethered stimulation tool of claim 1, further comprising a power boost circuit to charge a capacitor to switch a state of the magnet.

3. The tool of claim 2, wherein the power boost circuit powers the pressure pulse generator.

4. The untethered stimulation tool of claim 1, wherein the de-coupling the untethered stimulation tool is by switching the magnet.

5. The untethered stimulation tool of claim 1, wherein the releasing the ballast is by switching the magnet.

6. The untethered stimulation tool of claim 1, wherein the magnet is a first magnet and wherein the untethered stimulation tool further comprises a second magnet, and wherein the releasing the ballast is by switching the second magnet.

7. The untethered stimulation tool of claim 1, wherein the untethered stimulation tool further comprises a controller, and wherein:
- the controller comprises:
  - a processor; and
  - a storage medium, wherein the storage medium comprises instructions to direct the processor to:
    - measure data correlating to a depth in the wellbore;
    - release the ballast at a target depth;
    - switch a state of the magnet; and
    - activate the pressure pulse generator.

8. The untethered stimulation tool of claim 7, further comprising a pressure sensor to collect data correlating to depth.

9. The untethered stimulation tool of claim 7, further comprising a casing collar locator to collect data correlating to depth.

10. The untethered stimulation tool of claim 7, further comprising a pressure sensor to collect data correlating to depth.

11. The untethered stimulation tool of claim 1, wherein the tubular comprises a metallic wellbore casing.

12. The untethered stimulation tool of claim 1, wherein the pressure pulse generator comprises a piezoelectric actuator.

13. A method for stimulating a near-wellbore area, comprising:
- dropping an untethered stimulation tool from a wellhead into a tubular disposed in a wellbore at least partially filled with a wellbore fluid, the untethered stimulation tool comprising:
  - a main body, wherein the main body is formed at least in part from a material that is buoyant in the wellbore fluid;
  - a ballast;
  - a magnet; and
  - a pressure pulse generator, wherein the untethered stimulation tool is configured to, when the ballast is attached to the untethered stimulation tool, descend downhole within the tubular by a force of gravity;
- coupling the untethered stimulation tool by the magnet to an interior surface of the tubular upon arrival of the untethered stimulation tool at a downhole location proximate the perforation;
- when the untethered stimulation tool is coupled by the magnet to the interior of the tubular, activate a pressure pulse generator to transmit pressure pulses into the perforation, thereby dislodging material from the perforation;
- de-coupling the untethered stimulation tool from the interior surface;
- after de-coupling the untethered stimulation tool, releasing the ballast, thereby permitting the untethered stimulation tool to ascend uphole, driven at least partially by a buoyant force exerted by the wellbore fluids; and
- after releasing the ballast, retrieving the untethered stimulation tool at the wellhead.

14. The method of claim 13, wherein the untethered stimulation tool further comprises a power boost circuit to charge a capacitor to switch a state of the magnet.

15. The method of claim 14, wherein the power boost circuit powers the pressure pulse generator.

16. The method of claim 13, wherein the de-coupling the untethered stimulation tool is by switching the magnet.

17. The method of claim 13, wherein the releasing the ballast is by switching the magnet.

18. The method of claim 13, wherein the magnet is a first magnet and wherein the untethered stimulation tool further comprises a second magnet, and wherein the releasing the ballast is by switching the second magnet.

19. The method of claim 13, wherein the untethered stimulation tool further comprises a controller, and wherein:

the controller comprises:

a processor; and a storage medium, wherein the storage medium comprises instructions to direct the processor to:

measure data correlating to a depth in the wellbore;

release the ballast at a target depth;

switch a state of the magnet; and activate the pressure pulse generator.

20. The method of claim 13, further comprising determining a depth of the untethered stimulation tool.

21. The method of claim 13, wherein the tubular comprises a metallic wellbore casing.

22. The method of claim 13, wherein the pressure pulse generator comprises a piezoelectric actuator.

* * * * *